United States Patent [19]

Strain

[11] 4,409,919

[45] Oct. 18, 1983

[54] SHIP'S DOUBLE BOTTOM AND BAG SEGREGATED BALLAST SYSTEM

[76] Inventor: Patrick J. Strain, 27 Tanglewood Dr., Lynwood, Nepean, Ontario, Canada, K2H 6P5

[21] Appl. No.: 134,993

[22] Filed: Mar. 28, 1980

[51] Int. Cl.[3] ..... B63B 25/08

[52] U.S. Cl. ..... 114/74 R; 114/125; 220/85 B

[58] Field of Search ..... 114/74 R, 74 T, 74 A, 114/125, 256, 257, 333; 220/85 B

[56] References Cited

U.S. PATENT DOCUMENTS

| | | | |
|---|---|---|---|
| 2,102,590 | 12/1937 | Gray et al. | 114/74 R X |
| 2,891,672 | 6/1959 | Veld et al. | 114/74 R |
| 3,707,937 | 1/1973 | Liles | 114/74 R |
| 4,030,438 | 6/1977 | Telfer | 114/74 R |
| 4,117,796 | 10/1978 | Strain | 220/85 B X |
| 4,213,545 | 7/1980 | Thompson et al. | 220/85 B X |
| 4,228,754 | 10/1980 | Shibata et al. | 114/125 X |

FOREIGN PATENT DOCUMENTS

| | | | |
|---|---|---|---|
| 809695 | 3/1959 | United Kingdom | 114/125 |

*Primary Examiner*—Sherman D. Basinger

*Attorney, Agent, or Firm*—Burke-Robertson, Chadwick & Ritchie

[57] ABSTRACT

A system whereby use is made of a double bottom tank, in fluid communication with a bag made of reinforced elastomeric material to provide segregated ballast space in the cargo space of a ship. The double bottom space and bag are filled with ballast water when the cargo space is empty, thereby making use of the cargo space in which the bag is located to carry ballast water in space previously occupied by cargo, without having any cross-contamination of the ballast water by the cargo residues or gases. The outward and upward movement of the bag is restricted by a rigid guide cage. An open, or partially open, topped rigid container is placed around the guide cage to restrict the "free surface effect" of the ballast water in the unlikely event of failure of the ballast bag. A header tank is provided to keep a positive pressure head on the water in the bag when in the ballast condition. A semi-flexible float assists in guiding the bag during ballasting and de-ballasting operations.

8 Claims, 9 Drawing Figures

SHIP'S DOUBLE BOTTOM AND BAG SEGREGATED BALLAST SYSTEM

BACKGROUND OF THE INVENTION

Most oil tankers, on completion of cargo discharge, take ballast water directly into the almost empty tanks from which the cargo has recently been discharged. This is in order to stabilize the ship for its return journey to the loading terminal. The amount of ballast loaded is approximately one-third of the cargo carrying capacity of the tanker. The ballast also helps to immerse the hull, propeller, and rudder, in the sea, thereby improving the manoeuvring characteristics of the ship in the light (unloaded) condition. An unfortunate side effect of the above system is that the ballast water mixes with any oil residues remaining in the tanks from the cargo. In most cases the amount of residue remaining is relatively large, and this eventually has to be pumped into the sea together with the ballast water when the latter is discharged prior to loading another cargo.

In order to eliminate the above source of pollution, proposed international maritime rules will require most oil tankers to be fitted with a segregated ballast system, i.e. whereby the oil cargo and its residues are kept physically separated from the ballast water at all times. An obvious method to achieve this separation, is to have separate tanks and pumping systems for the cargo oil and the ballast. However, this means that in a tanker that would historically have carried (say) 300,000 tons of cargo, it will now only be able to carry approximately 200,000 tons, as approximately 100,000 tons of tank space will have to be dedicated to the carriage of ballast water.

The result of the foregoing will be a direct and obvious loss of cargo generated revenue to the shipowner or ship charterer.

It is with a view to overcoming the above problem, while still retaining a 100% pollution free operation, that the system according to the present invention has been devised.

DESCRIPTION OF THE PRIOR ART

U.S. Pat. No. 3,707,937 of Liles issued Jan. 2nd, 1973 discloses a caged concertina type flexible ballast container with guide rings which contract and expand to assist the concertina action during the discharge and the filling of the container through pipes. U.S. Pat. No. 2,696,185 of Snoddy issued Dec. 7th, 1954 shows a liquid cargo barge, which makes use of impermeable horizontal membranes in order to carry different fluids without cross-contamination. U.S. Pat. No. 3,943,873 of Hering and Schwartz issued Mar. 16th, 1976 uses vertical membranes to divide the cargo tanks of a tanker thereby allowing for the carriage of ballast water and oil cargo in the same space at different times without contamination of either fluid. U.S. Pat. No. 4,117,796 of Strain issued Oct. 3rd, 1978 discloses an impermeable semi-solid flexible horizontal diaphragm whereby ballast water and oil cargo can be carried in the same physical space at different times without having cross-contamination between the residues of either fluid. British Pat. No. 719,548 of Unthank and Silley illustrates another "concertina" type flexible containment system for the carriage of ballast water and cargo oil without cross-contamination.

SUMMARY OF THE INVENTION

The present invention may be summarized as a segregated ballast system wherein elastomeric impermeable bags are located on the double bottom tank tops of an oil tanker. Each bag is, by means of an opening (or openings) in the tank top, in fluid communication with double bottom tank over which it is located. Means, such as a remotely controlled valve fitted to the opening in the double bottom tank top, may be provided to control the flow of ballast water, to and from the bag, via the double bottom tank.

The ballast bag is guided and restricted in its movements by a rigid cage.

A small header tank, which is in direct fluid communication with the double bottom tank, is located at a sufficient height above the top of the bag when it is filled with ballast water, to ensure a positive hydraulic pressure head on the bag material, thereby preventing excessive movement of the ballast water in the bag and chaffing of the reinforced elastomeric material of the bag against the guide cage, due to ship motion.

An air vent pipe fitted to the double bottom tank ensures that air does not accumulate in the ballast bag over a period of time. Any air tending to accumulate will be expelled through the vent pipe due to the weight of the cargo oil acting on the ballast bag when it is empty.

Should the stability calculations for a particular cargo tank show that failure of the ballast bag, or bags, in that tank would cause stability problems due to the "free surface effect" of the released ballast water, then an emergency ballast water containment system can be fitted outside the guide cage. This emergency system will contain the ballast water under bag failure conditions, but will allow cargo oil to flow out, through a remotely controlled valve, by gravity means when the cargo is being discharged.

On crude oil carriers, a crude oil washing system is arranged to clean the oil side of the ballast bags and the inside of the emergency containment system.

The ballast bag is held in position at its lower end by suitable means, such as flangers or clamp-bars, to form an oiltight/watertight joint between the ballast bag, and the guide cage or double bottom tank top.

The ballast bag material consists of a reinforced elastomer, the properties of which include resistance to abrasion and tearing, and compatibility with sea water, hot and cold crude and other oils and chemicals.

An object of the present invention is to overcome the problem of revenue loss to the shipowner, or ship charterer, of the standard segregated ballast tanker. This revenue loss results from the transfer of revenue generating cargo space, to non-revenue generating dedicated clean ballast space, due to proposed international regulations. This problem is in large part overcome in the present invention by using some of the "dedicated segregated ballast space", as cargo carrying space, while still retaining the pollution-free features of the standard segregated ballast system.

A further object of the present invention is to conserve valuable bunker fuel. As a tanker fitted with the present invention, in comparison with a standard segregated ballast tanker of identical cargo carrying capacity, will use less fuel to carry an identical amount of cargo, over the lives of the respective ships.

Another object of the invention is to allow the shipowner to have a smaller ship, in comparison with a standard segregated ballast tanker of identical cargo carrying capacity, thereby allowing savings on steelwork during construction, and on operational costs over the life of the ship.

BRIEF DESCRIPTION OF THE DRAWINGS

Other objects of the invention will become apparent upon reading the following detailed description and upon referring to the drawings in which.

In the drawings, like characters of reference designate similar parts in the several Figures.

DETAILED DESCRIPTION OF THE INVENTION

For clarity, emphasis throughout this detailed description will be placed on the invention as applied to oil tankers and double bottom tanks, but it will be understood that the invention, with slight and obvious modification is also suitable for use in cargo ships and with other tanks.

All materials may be of steel, with the exception of the bags and attached floats, and gaskets and packings for valves and manhole covers.

Figure 1:
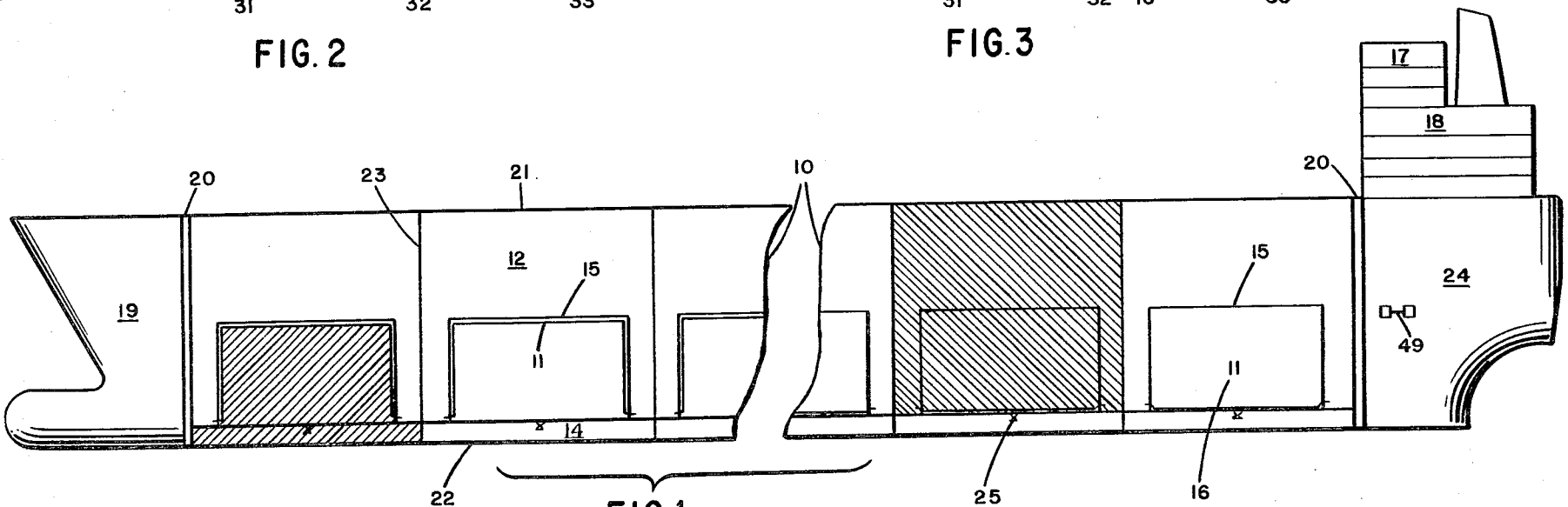
FIG. 1 is a longitudinal cross-sectional elevation of a V.L.C.C. (very large crude oil carrier) fitted with the present invention in its cargo tanks. The part of the drawing forward of the broken lines show the ship in the ballasted condition. The part of the drawing aft of the broken lines show the ship in the loaded condition.

Referring to FIG. 1, this teaches the basic principles underlying the present invention and shows only the main parts of the system. The part of tanker 10 forward of the broken lines represents the condition of the ship in the ballasted condition. In this condition the reinforced elastomer ballast bags 11 are filled with ballast water and are therefore in the raised position and pressed tightly against the guide cages 15. The dedicated cargo only portions of the cargo spaces 12 are empty. The double bottom spaces 14 are also filled with ballast water and may be in fluid communication with the contents of the ballast bags 11, through the remotely controlled ballast valves 25, which may be left open at the captain's discretion.

The part of the tanker 10 aft of the broken lines represents the ship in the cargo loaded condition. The cargo tank spaces 12, including the spaces inside the guide cages 15, are completely filled with cargo oil. The empty ballast bags 11 are pressed by the weight of the cargo against the parts of the double bottom tank tops 16 that are located inside the guide cages 15. The navigation bridge 17, crew accommodation 18, bow spaces 19, void spaces 20, main deck 21, bottom plating 22, and transverse bulkheads 23, are conventional. The machinery spaces 24 are also conventional, except that any machinery such as a hydraulic oil pump 49, for operating the control valves 25 (when fitted) may be located in these spaces. The cargo oil loading and unloading arrangements are conventional and are not shown in the drawings.

It will be noted that the spaces inside the guide cages 15, are alternatively used for the carriage of cargo oil and ballast water, without any cross-contamination between the primary substance transported at a particular time, and the remaining residue and gases of the substance previously transported. The volume of oil contained inside the guide cages 15 in the cargo loaded condition is therefore excess cargo capacity for the shipper, in comparison with the standard segregated ballast tanker.

Figure 2:
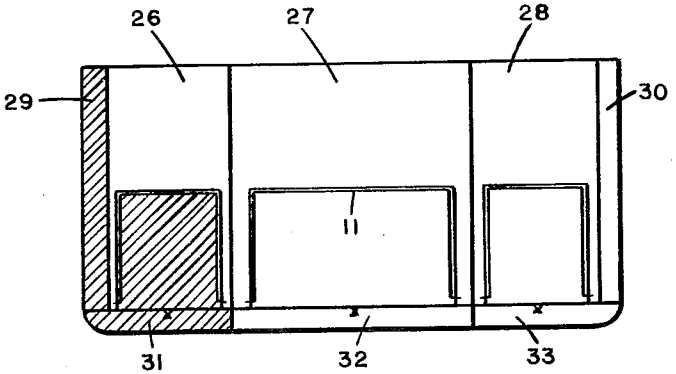
FIG. 2 is a transverse cross-sectional elevation of the forward part of FIG. 1.

Referring to FIG. 2, the starboard cargo tank 26, centre cargo tank 27, and port cargo tank 28 are empty; except for the ballast water in the ballast bags 11. The starboard protective wing tank 29, port protecting wing tank 30, and the three double bottom tanks, starboard 31, centre 32, and port 33, are also filled with ballast water.

Figure 3:
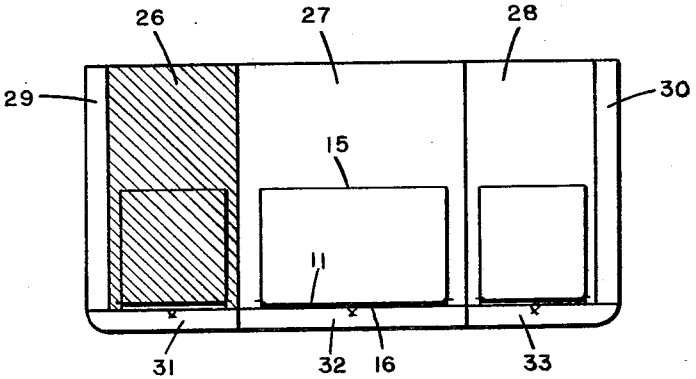
FIG. 3 is a transverse cross-sectional elevation of the aft part of FIG. 1.

Referring to FIG. 3, as this is a cross section of the tanker in the loaded condition, the starboard cargo tank 26, centre cargo tank 27, and port cargo tank 28, including the spaces inside the guide cages 15, are filled with cargo oil. The starboard protective wing tank 29, port protective wing tank 30; and the three double bottom tanks, starboard 31, centre 32, and port 33, are empty. The weight of the cargo oil presses the reinforced elastomer material of the empty ballast bags 11 tightly against the part of the double bottom tank tops 16 that are inside the guide cages 15.

Figure 4:
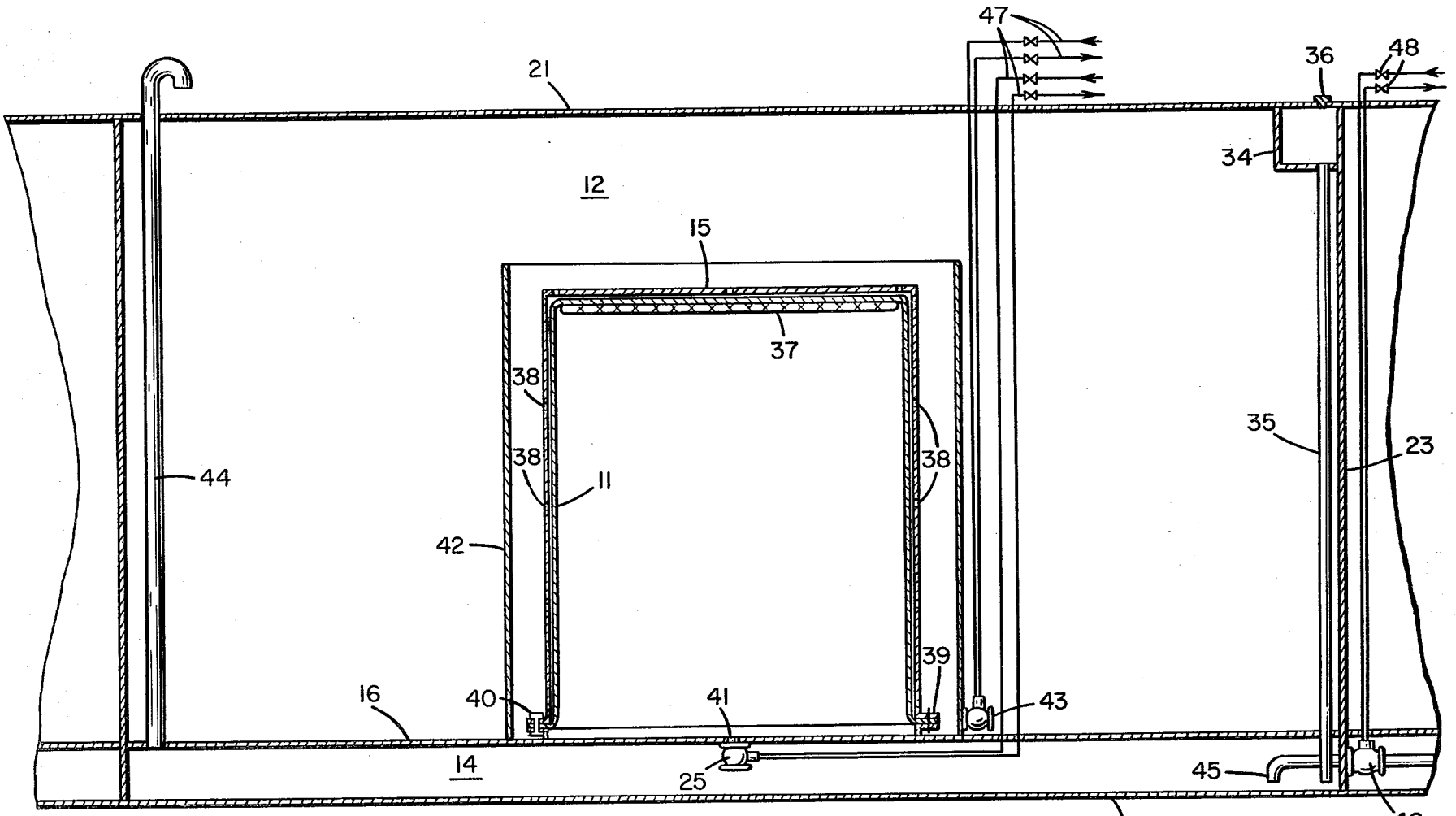
FIG. 4 is a longitudinal cross-sectional elevation of a cargo tank fitted with the present invention. The drawing shows a cylindrical shaped bag in the ballasted condition.

Referring to FIG. 4, this is a drawing of a cargo tank that is fitted with the present invention and is in the ballasted condition. The cargo space 12 is empty, except for the ballast water in the cylindrical ballast bag 11, which is full and is in fluid communication, through the hole 41 and control valve 25, with the double bottom space 14, which is also filled with ballast water. A header tank 34, which is located at the aft end of cargo space 12 and at a height greater than the top of the cylindrical guide cage 15, is also in fluid communication, through sounding pipe 35, with the water in double bottom space 14. Header tank 34 is kept full of ballast water, when in the ballasted condition, thereby exerting a positive outwards and upwards pressure on the ballast bag 11, to hold the latter firmly in place against the guide cage 15. An access plug 36 for tank sounding purposes is fitted in top of the header tank.

A semi-rigid guide float 37, which can be composed of buoyant plastic or similar material, is fitted to the inside of the top of ballast bag 11. The purpose of the guide float 37 is to help locate the ballast bag 11 correctly in its raised (ballasted) or lowered (cargo loaded) position.

Numerous small holes 38 are drilled in the guide cage 15, in order that cargo oil can flow inside the guide cage space during loading operations. The size and finish of holes 38 shall be such that damage to the ballast bag 11 reinforced elastomer material is avoided under ballasted conditions.

The ballast bag 11 is specially shaped and moulded during manufacture to suit the guide cage 15, including flanges 39 and flange bolts 40.

An optional emergency container 42, is fitted around the outside and near the guide cage 15. The top of the emergency container 42 can be either fully or partially open. A remotely controlled container valve 43 is fitted low on the aft end of the emergency container 42.

The purpose of the optional emergency containment system is to restrict the movement of the ballast water in the event of ballast bag 11 failure, thereby minimizing the "free surface effect" of the released ballast, where this is considered a potential danger due to tank configuration. Container valve 43 is kept closed in the ballasted condition and is left open in the cargo loaded condition.

An air vent pipe 44 is fitted to the forward end of the double bottom tank.

The ballast water filling and discharge system 45 is conventional and may be controlled by remotely operated ballast valve 46.

The control system for the remotely controlled ballast bag control valve 25, container control valve 43, ballast control valve 46, and cargo filling and discharge valves, can be a hydraulic system with hydraulic oil pipes 47 and hydraulic valves 48 in connection with the hydraulic oil pump 49 (FIG. 1) which can be located in the machinery space 24 (FIG. 1).

Figure 5:
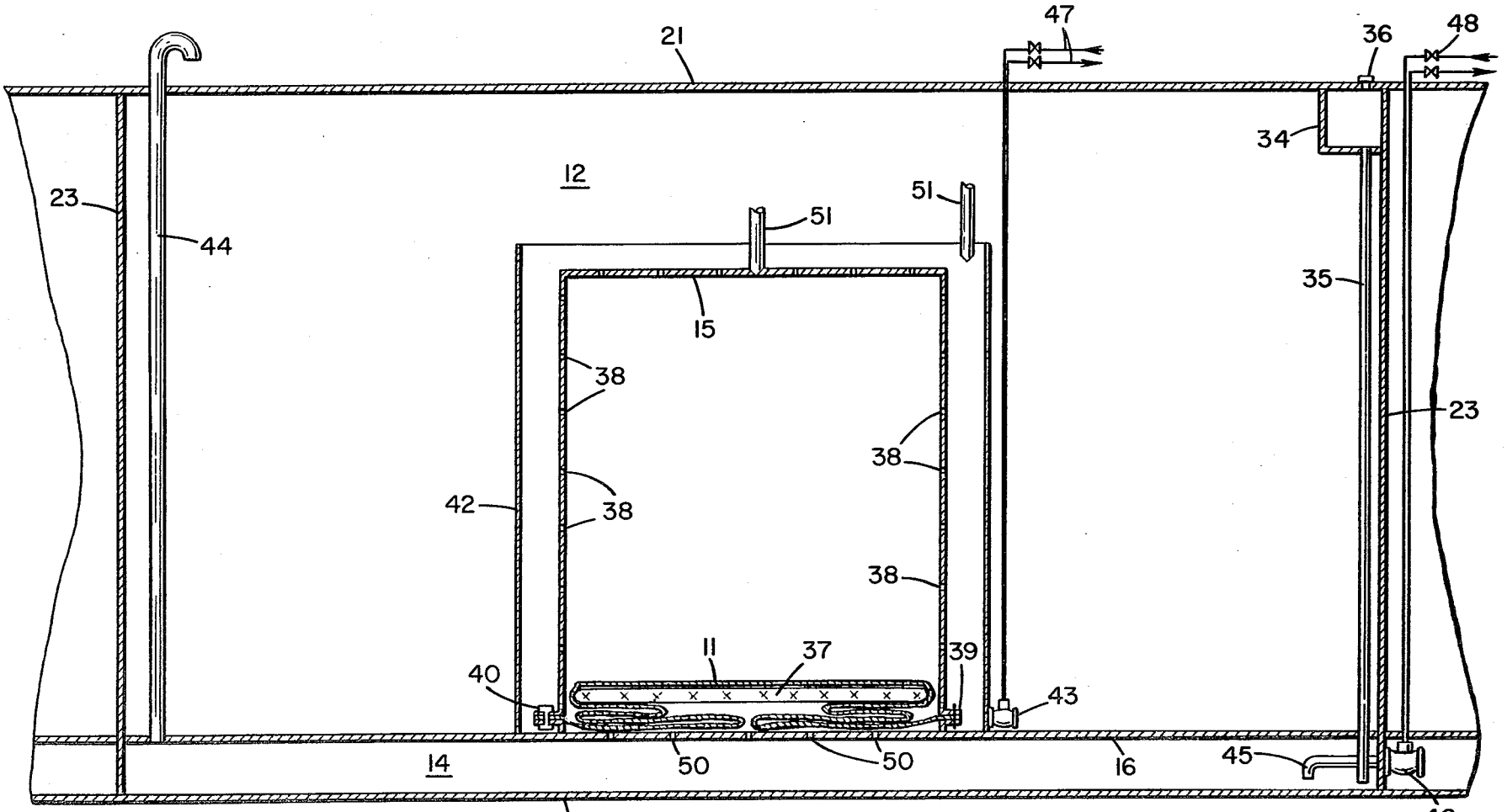
FIG. 5 is a longitudinal cross-sectional elevation of another cargo tank fitted with the present invention. The drawing depicts the cargo loaded condition.

Referring to FIG. 5, this is a similar system to that depicted in FIG. 4, but with the following exceptions:

- The system is in the cargo loaded condition. Therefore the cargo space 12, including the space inside the guide cage 15 is filled with cargo oil.
- The double bottom space 14, and header tank 34 are empty.
- The empty ballast bag 11 is held against the double bottom tank top 16 by the weight of the cargo oil.
- In lieu of the ballast bag control valve 25 (FIG. 4), small grid holes 50 are drilled in the double bottom tank top 16 inside the guide cage 15 area to allow communication between the inside of ballast bag 11 and double bottom space 14. This is an optional feature to the shipowner's requirements.
- The emergency container valve 43 is in the open position.
- Assuming the cargo is crude oil, a conventional crude oil washing system, with washing nozzles 51, is fitted. The nozzles 51 are positioned to clean inside the guide cage 15 and emergency container 42. The washing operation will be carried out as the cargo oil in the tank is being discharged, and with the inert gas system in operation.

Figure 6:
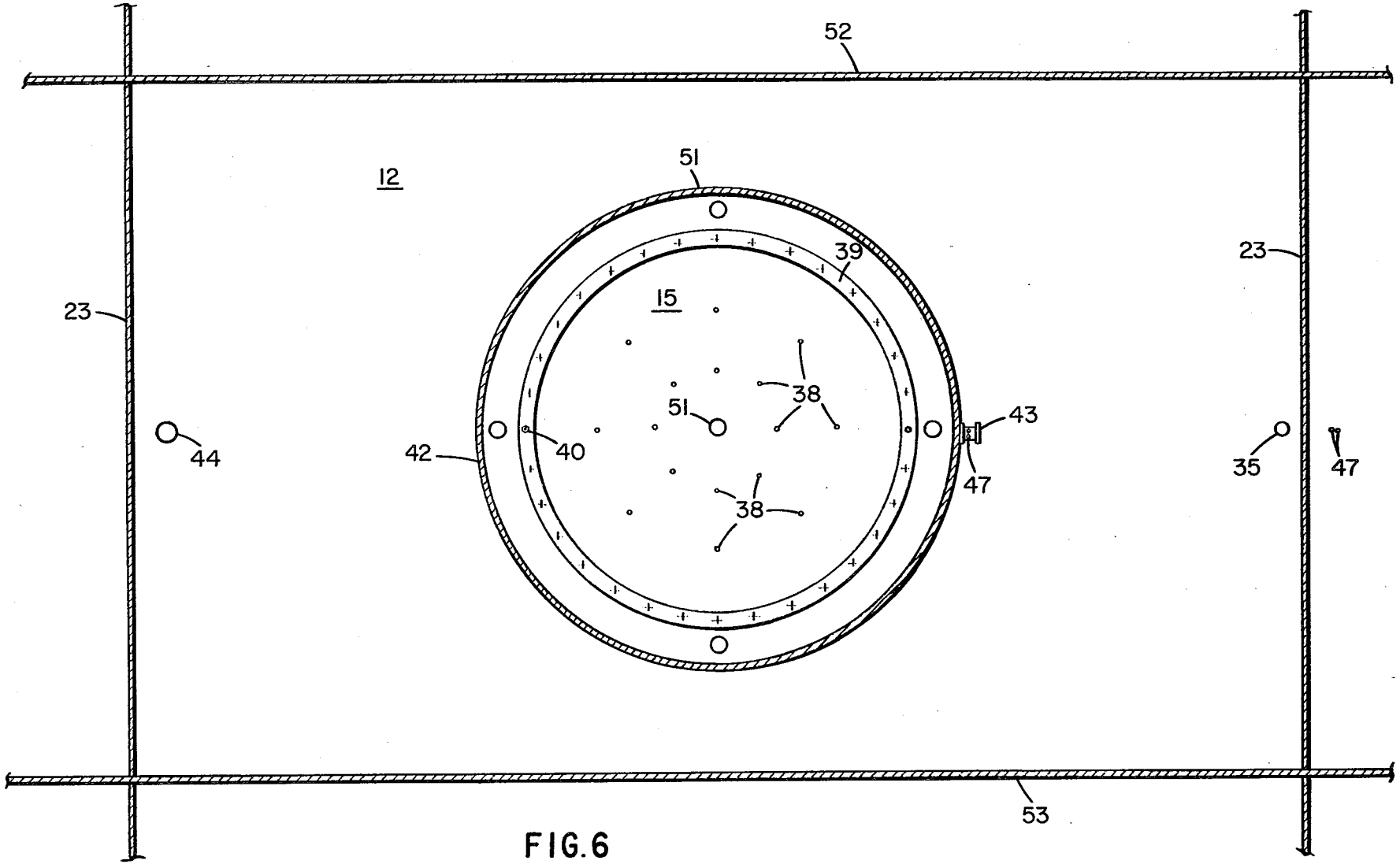
FIG. 6 is a plan view of FIG. 4, from a position just above the top of the guide cage.

Referring to FIG. 6, this is a plan view of FIG. 5 from a position just above the guide cage 15. The starboard bulkhead 52 and the port bulkhead 53 of the tank are conventional.

Figure 7:
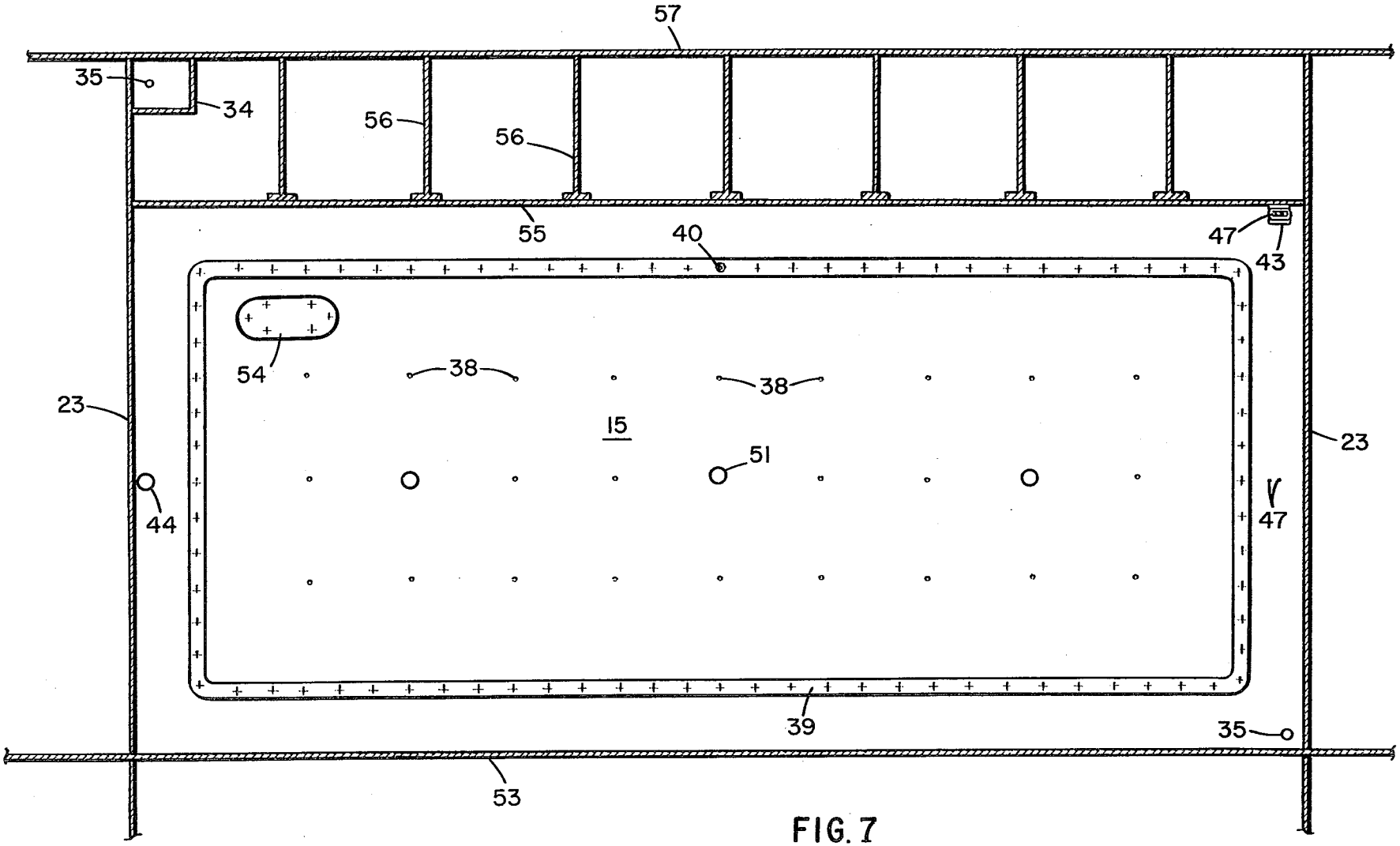
FIG. 7 is a plan view of a configuration of the present invention in which the ballast bag is of rectangular shape.

Referring to FIG. 7, a ballast bag, which is shaped to conform with the contours of rectangular guide cage 15, is fitted in this plan view of the present invention.

A manhole 54 allows access to the interior of the guide cage 15, for inspection and maintenance purposes.

The transverse bulkheads 23, and port bulkhead 53, in conjunction with containment barrier 55, are used for emergency containment of the ballast water, in the event of ballast bag 11 failure in the ballasted condition. The containment barrier 55 reaches a height approximately level with the top of the guide cage 15.

The containment barrier 55 is attached to the side frames 56, which in turn are connected to the starboard ship's side plating 57—assuming that there is no protective ballast tank on the ship's side at this position.

Remotely controlled container valve 43 is fitted as low as possible on the containment barrier 55, in order that the frame spaces may be efficiently drained of cargo oil. The container valve 43 is left open in the cargo loaded condition, and is closed in the ballasted condition.

With slight and obvious modifications this Figure could also apply to a tank fitted with a square shaped container.

Figure 8:
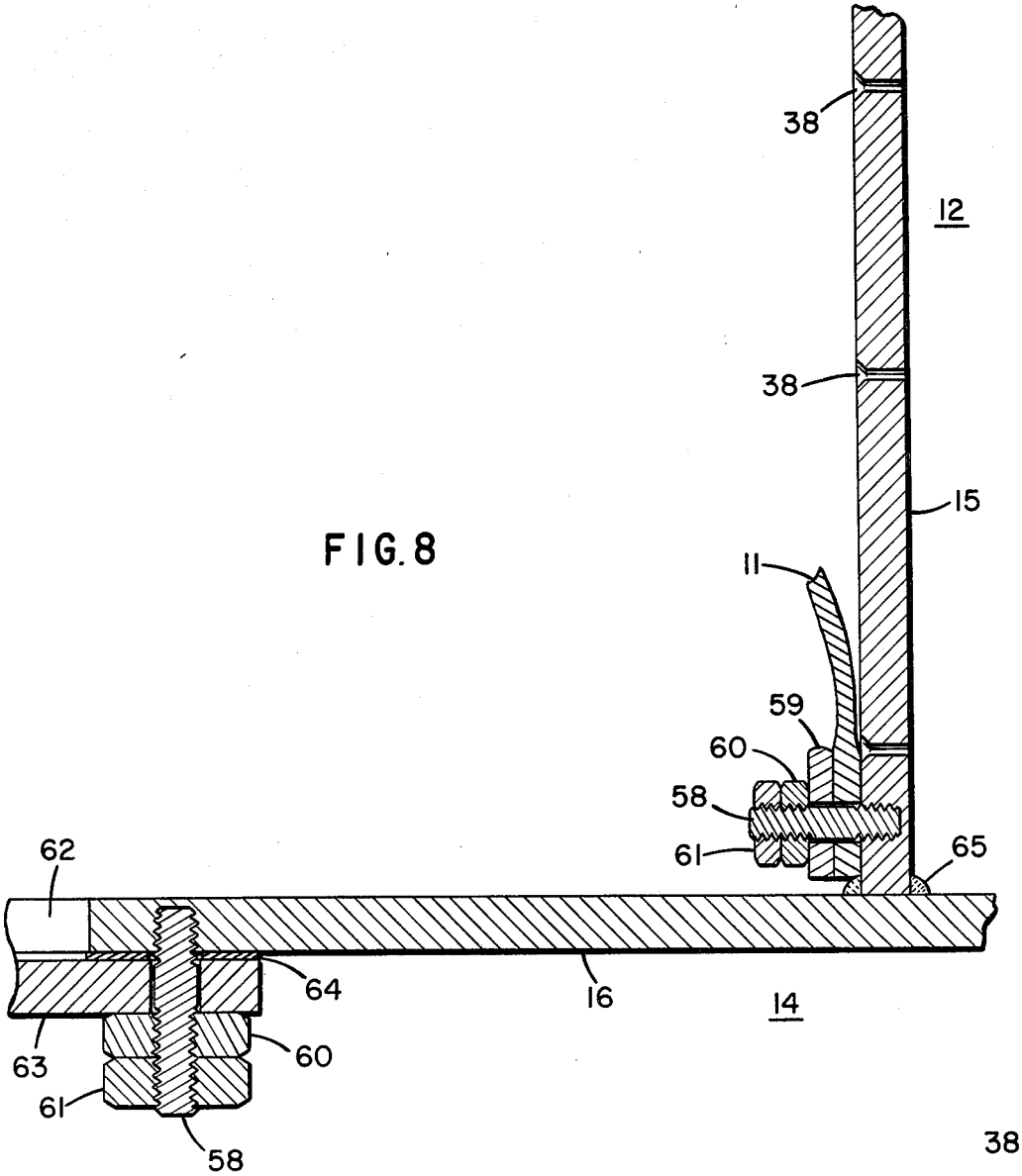
FIG. 8 is a cross-sectional elevation of an optional jointing arrangement between the ballast bag and the guide cage.

Referring to FIG. 8, this is an alternative jointing arrangement to the flange type connection between the lower end of the ballast bag 11, and the guide cage 15.

The lower end of the guide cage 15 is welded 65 to the double bottom tank top 16. A horizontal row of studs 58 is fitted as low as possible around the inside of the guide cage 15. Holes corresponding to the stud positions are punched in the lower end of the ballast bag 11. The punched holes in the ballast bag 11 are then pushed over the studs 58, and suitably shaped and drilled clamp bars 59 are placed over the studs 58 and against the ballast bag 11. Nuts 60 are now placed on the studs 58, and tightened against the clamp bars 59, thereby forming an oiltight/watertight seal between the outside and inside of the ballast bag 11. Finally, locknuts 61 are fitted on the studs 58 and tightened in position.

An access manhole 62, together with a manhole cover 63 and gasket 64, is fitted to that part of the double bottom tank top 16, which is inside the guide cage 15.

Figure 9:
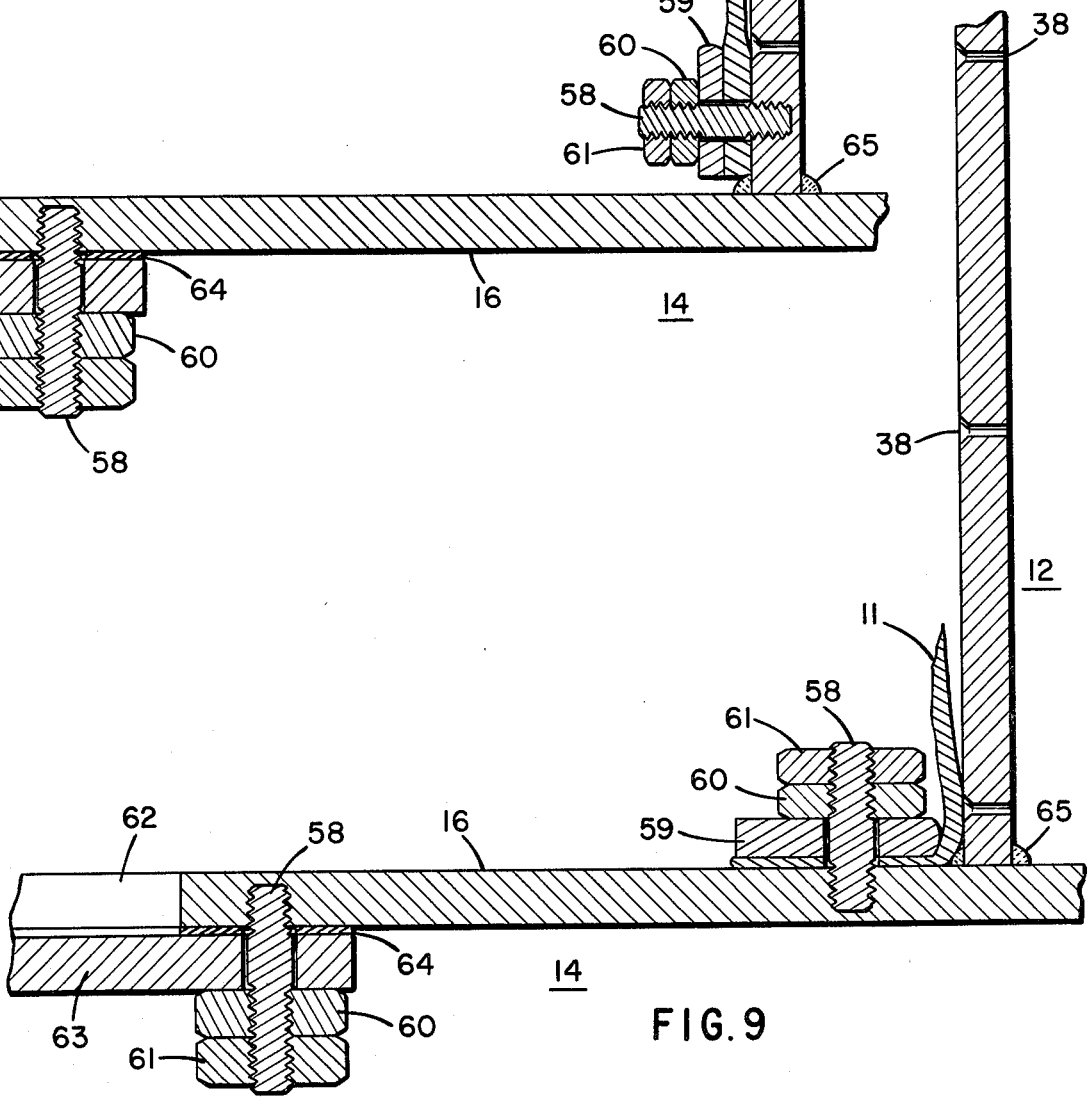
FIG. 9 is a cross-sectional elevation of another optional jointing arrangement between the ballast bag and the double bottom tank top.

Referring to FIG. 9, this is similar to FIG. 8, with the exception that the lower end of the ballast bag 11 is clamped directly to the double bottom tank top 16.

OPERATION OF THE INVENTION

The operation of the invention will now be described.

Referring to FIG. 4, assuming the discharge of crude oil from the cargo space 12 has been completed and it is desired to take on ballast in preparation for the return voyage to the loading terminal.

The outlet of air vent pipe 44 is checked to see that it is not obstructed. Then sounding plug 36 is removed, ballast bag control valve 25 is opened, and container valve 43 is closed. Ballast water is now allowed into the double bottom space 14, by opening ballast valve 46 and starting the ballast pump.

When the double bottom space 14 is full, ballast water will start to flow through control valve 25 into the ballast bag 11. The ballast bag 11, which will be lying on the double bottom tank top 16 inside the guide cage 15 (as depicted in FIG. 5), due to the action of the ballast water pressure and of the guide float 37, will now start to open until it completely fills the space inside the guide cage 15—thereby allowing the ballast water to occupy the same physical shape that had been recently occupied by part of the cargo oil, while avoiding any cross-contamiation between the two substances.

When the ballast water reaches a suitable height in the header tank 34, the ballast pump can be stopped and ballast valve 46 closed.

In the unlikely event of failure of the reinforced elastomer ballast bag 11 during the voyage in the ballasted condition, the emergency container 42, with container valve 43 in the closed position, will restrict the free flow of ballast water inside cargo space 12—thereby reducing what in some cases may be a dangerous (from a ship stability point of view) "free surface effect" of the released ballast water.

Upon reaching the loading terminal the clean ballast water in the ballast bag 11 and double bottom space 14 is pumped overboard. The container valve 43 is opened and the cargo oil is loaded into cargo space 12 in the conventional manner. As cargo space 12 fills, oil will flow, through the small holes 38, inside the guide cage 15.

When any air in the ballast bag 11 has been expelld by the weight of the cargo oil acting on the outside of ballast bag 11, the ballast bag control valve 25 can be closed as a precautionary measure.

Upon return to the discharging terminal, the cargo is discharged in the conventional manner, and if the cargo is crude oil, the crude oil washing system can be used to clean inside the guide cage 15 and the emergency container 42.

It will be noted from the above description, that any cargo oil carried inside the guide cage 15 will occupy "dedicated clean ballast space", thereby providing the shipowner and charterer with extra cargo revenue in comparison with a standard segregated ballast tanker.

While certain novel features of my invention have been shown and described and are pointed out in the appended claims, it will be understood that various substitutions, omissions, and changes in the form and details of the device illustrated and in its operation can be made by those skilled in the art without departing from the spirit of the invention. Therefore what has been set forth is intended to describe and/or illustrate such concept and is not for the purpose of limiting protection to any herein particularly described embodiment thereof.

I claim as my invention:

1. A segregated ballast system for a double bottomed ship comprising a flexible, impermeable container, located in the cargo space of the ship but not internally communicating therewith and in fluid internal communication with the double bottom space of said ship, the container being surrounded by a cage-like rigid porous guide and support means; means for passing ballast water out from and into the double bottom space and flexible container as required; air vent means to permit escape from the container of air entrapped therein; and the container and rigid porous guide being circumscribed by and contained within the walls of an emergency container to restrain the free flow of ballast water within this emergency container in event of failure of the flexible container, said cargo space being defined by longitudinal and transverse bulkheads, the walls of said emergency container being separate from any cargo space defining bulkheads.

2. A system according to claim 1 in which the container consists of a plain sheeting of reinforced elastomer whose properties include resistance to abrasion and tearing, and compatibility with sea water, and hot and cold crude oil and other oils and chemicals.

3. A system according to claim 1 further comprising a header tank located above the highest part of the container and in fluid communication with the interior of the container.

4. A system according to claim 1 in which the guide and support means consists of a rigid hollow cylinder which is open at one end or side and in whose sides and closed end are located small holes.

5. A system according to claim 1 wherein a float is provided within the container as additional guide means for the container.

6. A flexible impermeable container according to claim 1 in which one end of the container is open and is suitably attached by means of flanges and clamp bars to that end of the cage-like rigid porous guide and support means that is connected to the double bottom space or by means of clamp bars the container is connected directly to the top of the double bottom space.

7. A container and double bottom space according to claim 1 in which the fluid internal communication between the two is controlled by means of a valve.

8. The structure of claim 1 in which the double bottom space is a double bottom tank of a tanker.

* * * * *